United States Patent [19]

Sherburn

[11] 4,067,628

[45] Jan. 10, 1978

[54] FOAM-INSULATED SIDE-BY-SIDE REFRIGERATOR

[75] Inventor: Raymond Robert Sherburn, Montreal, Canada

[73] Assignee: Canadian General Electric Company Limited, Toronto, Canada

[21] Appl. No.: 693,766

[22] Filed: June 8, 1976

[30] Foreign Application Priority Data

June 13, 1975 Canada ..... 229457

[51] Int. Cl.[2] ..... A47B 81/00; F25D 11/00; B65D 25/18

[52] U.S. Cl. ..... 312/214; 220/9 F

[58] Field of Search ..... 312/214, 236; 220/9 F, 220/9 G

[56] References Cited

U.S. PATENT DOCUMENTS

| | | | |
|---|---|---|---|
| 1,369,338 | 2/1921 | Hillman | 312/214 |
| 1,747,969 | 2/1930 | Carrey | 312/214 |
| 3,038,769 | 6/1962 | Smith | 312/214 |
| 3,177,271 | 4/1965 | Slayman | 312/214 |
| 3,601,463 | 8/1971 | Watt | 312/214 |
| 3,674,359 | 7/1972 | Crowe | 312/214 |
| 3,940,195 | 2/1976 | Tillman | 312/214 |
| 3,989,329 | 11/1976 | Benford | 220/9 F |

*Primary Examiner*—Paul R. Gilliam
*Assistant Examiner*—Victor N. Sakran
*Attorney, Agent, or Firm*—Steven C. Schnedler; Francis H. Boos

[57] ABSTRACT

In a side by side refrigerator-freezer appliance, thermal leakage between the compartments is reduced by forming the liners separately for each compartment, but without the partition wall. Adjacent edges of the liners are spaced apart and desirably out-turned to form a truncated V groove. A partition wall is separately formed and foam insulated; edges of the partition are upset to form a tongue slidable along the groove whereby the partition is retained in position.

6 Claims, 4 Drawing Figures

FOAM-INSULATED SIDE-BY-SIDE REFRIGERATOR

The present invention relates to a refrigeration appliance including a freezer compartment and a fresh food compartment wherein the two compartments are in side by side relationship.

One problem associated with this type of appliance concerns the temperature control within the fresh food compartment. It is often found that thermally stable conditions cannot be obtained therein due to undesired heat transfer between the two compartments. It is a primary aspect of my invention to provide a simple, reliable appliance wherein conductive paths between the compartments are minimized.

Typical side-by-side refrigerators of present day manufacture are generally rectangular prisms and comprise an open fronted outer encasement and an inner liner therefor, the liner being spaced from th encasement and the spacing filled by an in-situ generated foam insulation. Generally, either of two methods are normally employed in providing a partitioned compartment of the required form. In the first method, a complete liner is formed for each compartment; each liner consists of a top, bottom, rear and inner and outer side walls, the inner side wall of each of the liners together forming the partition wall. The two lines are placed side-by-side within an encasement and the wall cavities foam insulated in a single operation. Whilst this method should provide for a minimal thermal bridging between the two compartments, in practise difficulty is often experienced in attaining the requisite degree of insulation between the compartments, for the relative complexity of the wall structures tends to prevent a complete penetration of foam into the cavity of the partition wall. The void areas offer poor insulating protection; they are not usually detected until the appliance is placed in service, being manifest in poor and erratic temperature control in the refrigerator compartment, and it is difficult to rectify the deficiency. Additionally, during the foam insulation process the liner and encasement walls are subject to considerable pressure which requires them to be supported by male and female moulds termed collectively a foaming fixture. Because of the relative complexity of the wall formation in this method, the cost of the foaming fixtures add significantly to the final cost of the appliance.

The second of the referred to methods comprises forming a single liner for the encasement and separately forming an insulated partition wall, which is subsequently affixed to divide the compartments. This method is advantageous in that the foaming fixture is simple, and often the same fixture may be employed for both a single and dual compartmented appliance; also the quality of the foam insulation is generally good and reproducible. The prime disadvantage of this method is that the area of liner which interconnects the two compartments provides an undesirable thermal leakage path. It is known to provide slots in this area, to reduce the area of the link, but even where this expedient is adopted erratic performance may still be experienced.

My invention contemplates a hybrid structure wherein separate liners are formed for each compartment but wherein the inner side wall of each liner, i.e. that wall which forms the partition, is omitted. The adjacent edges of the two liner parts do not touch, hence they provide no thermal link. The liner parts are positioned in the refrigerator encasement, the adjacent edges sealed, at least temporarily, and the structure foam insulated. This part of the operation proceeds with a facility equal to that of the second above method. The partition wall of my invention comprises a pair of spaced sheet members that are noncontiguous along their edges; foam is introduced into the spacing between the sheet members to insulate and rigidify them. The partition is secured within the lined shell with one sheet member forming the inner wall of each compartment. There is thus no short path metal bridge between the two compartments whereby excessive and undesirable heat transfer may take place.

My invention further contemplates forming complementary tongue and groove means integrally with the partition wall and the liners whereby the partition wall may be slid into position to be substantially retained in a vertical plane within the appliance. These aspects and others of my invention are further discussed in relation to a preferred illustrated embodiment as shown in the accompanying drawings wherein FIG. 1 shows in perspective a compartmentalized refrigerating appliance of the type previously referred to;

Figure 1:
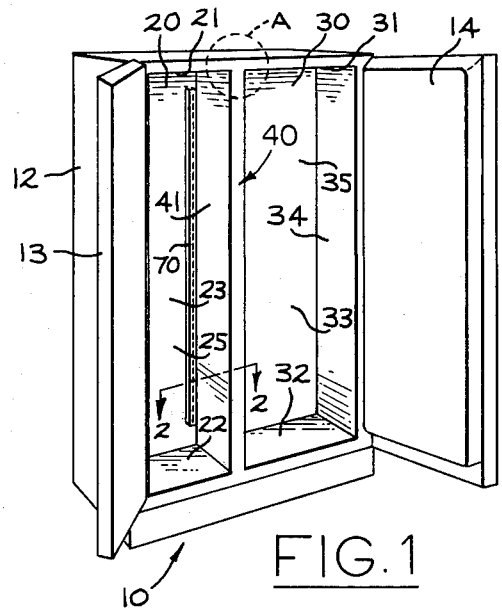
Figure 4:
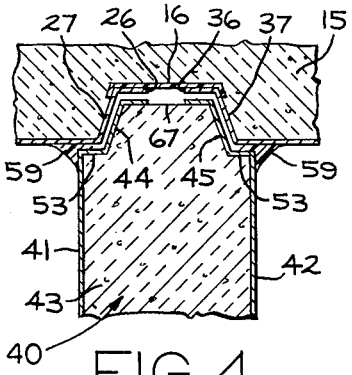
Figure 3:
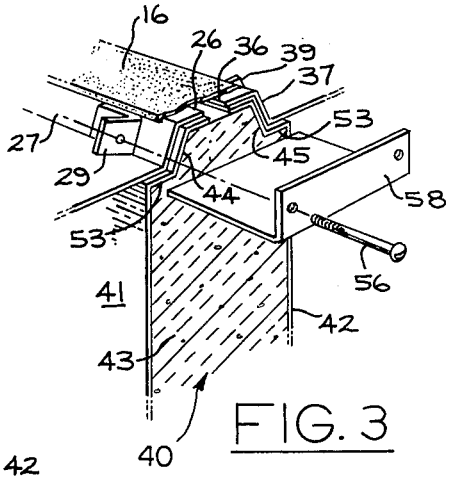
FIG. 3 is a perspective view broken away area of A of FIG. 1, partially disassembled, to show detail of fixing.
Figure 2:
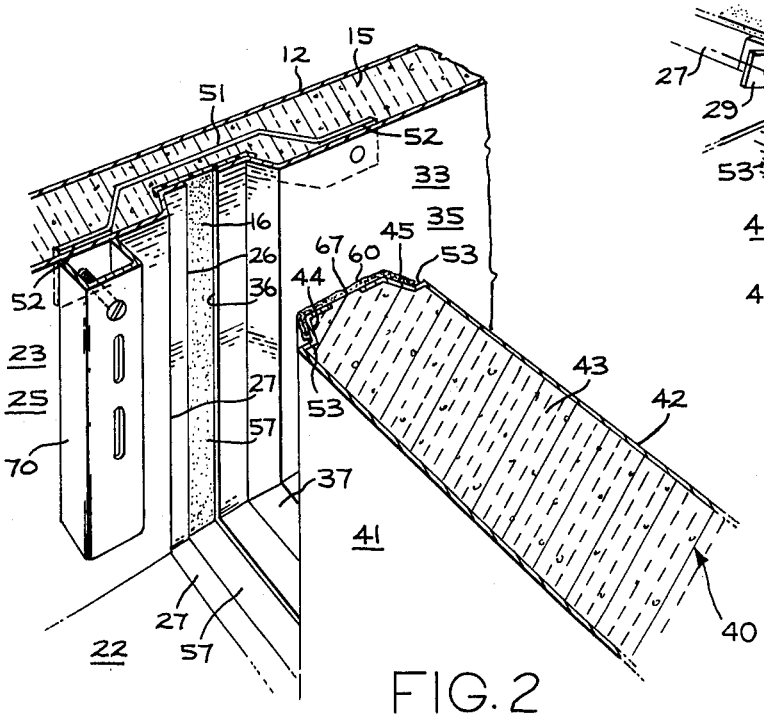
FIG. 2 shows in perspective a view along section line 2—2 of FIG. 1 with the structure partly disassembled for greater clarity.

FIG. 4 shows in plan form a structural variation of FIG. 2, although not showing all the detail of the latter figure Referring now to the figures, a compartmentalized refrigerating appliance is identified generally by the numeral 10, and this comprises an outer encasement 12 and two inner compartments 20 and 30 either of which may be designated a freezer compartment, the remaining compartment being for fresh food storage. Compartments 20 and 30 are separated by a partition wall 40, and doors 13 and 14 are provided to enclose each of the compartments. Compartment 20 is delimited by walls including upper wall 21, lower wall 22, rear wall 23 and outer side wall 24, these walls together forming a unitary liner 25; compartment 30 is delimited similarly by walls 31–34 which together form a unitary liner 35. These liners will generally be formed from folded sheet steel of a light gauge. As may be seen in FIG. 2, when the liners are positioned within encasement 12, the adjacent edges of walls 23 and 33, identified respectively as 26 and 36, are spaced apart. This spacing is continuous between the facing edges of each wall pair 21–31, 22–32 and 23–33. There is thus no short thermally conductive path between the two liners. The actual spacing may vary considerably but it is desirably less than the thickness of partition forty so that it is ultimately concealed when the partition is secured in position. Liners 25 and 35 may be interconnected by one or more bridging members 51; the conductive path between their points of connection to the liners is relatively long, hence the thermal leakage along them will be comparatively low. Leakage may be further reduced by inserting an insulating material 52 between the bridging member 51 and its points of attachment to the liner. Bridging members 51 are intended to serve two purposes: to assist in positioning liners 25 and 35 with encasement 12 prior to the assembly being foam insulated, and to serve as stiffing points for the subsequent attachment of stringer members 70 which support a shelving system within the apparatus. The bridging members may be omitted or supplemented according to the particular circumstances.

The liners 25 and 35 are positioned within encasement 12 and all openings sealed; adhesive tape 16 has been found suitable for sealing smaller openings such as that between the facing edges of liners 25 and 35. Larger openings are preferably sealed by means of heavy re-usable gaskets. The various walls are supported by male and female moulds forming the foaming fixture (not shown), and a foamable polyurethane resin composition introduced in the space between the wall of encasement 12 and the liners to provide a foam insulation 15 therebetween. For a detailed description of this type of in situ foam insulation method, reference may be made, inter alia, to the following Canadian patents:

808,613 issued March 1969, to Gobeiller,
815,220 issued June 1969, to Gondeck et al
845,677 issued June 1970, to Pulaski.

Partition 40 is a sandwich construction comprising two completely separate, spaced apart sheet members 41 and 42 having a foamed insulation 43 therebetween. Since partition 40 is generally planar, it may be prepared by an in situ foaming process or by glueing sheet members 41 and 42 to a preformed slab of foam 43. The edges of sheet members are arranged to be spaced apart such that when partition 40 is secured in apparatus 10 to compartmentalize in neither sheet member touches a part of the liner wall of an opposing compartment.

The precise method of securing partition 40 within apparatus 10 is a matter of choice. However the mehod which I have adopted and which forms part of the present invention includes forming complementary means on the liner and on the partition which cooperate to retain the partition in position. A preferred form of the complementary means is illustrated in the drawings and comprises a channel 57 formed by out turning portions of adjacent edges of the liners 25 and 35 as at 27 and 37, to form a truncated V section. A complementary tongue 67, is formed by upsetting edge portions 44 adn 45 of sheet members 41 and 42 of partition 40, whereby the partition may be positioned by sliding the tongue 67 along the mating channel. Partition 40 will desirably have a thickness greater than the width of channel 57 to permit the formation of shoulders 53 intermediate planar portions of the sheet members 41 and 42 and edge portions 44, 45, thereby stiffing the partition 40. When the partition is in position to divide compartments 20 and 30 evidence of the joint is concealed and no edges of the various panels are exposed to give rise to rust spotting in the compartments. It is desirable to provide a sealant between partition 40 and the mating walls of the two compartments; this may be in the form of a resilient foam strip 60 which may be adhered to the tongue 67 of partition 40, as shown in FIG. 2, prior to the partition being positioned; alternatively or additionally a resilient mastic filler 59 shown in FIG. 4, may be employed. The use of resilient foam strip may be advantageous in acting as a bulky filler to compensate for minor distortions in the joint area. While channel 57 and the mating tongue 67 have been shown as extending around three sides of the cabinet structure, it will be apparent that the mating means on the back wall of the cabinet could be omitted entirely and a simple butt joint be employed in this area.

Partition 40 may be conveniently retained in position by means of a simple bracket 58 which is secured by screws 56 to lugs 29 and 39 suitably attached to outer portions of channel 57. Bracket 58 will of course be masked by a breaker strip which normally joins the area between the forward edges of liners 25 and 35 and adjacent edges of encasement 12. Bracket 58 may be constructed of a low conductivity material such as a thermoplastic, but this has not in general been found necessary as it provides a thermal link between only some 2 to 4% of the total boundary perimeter of partition 40.

Whilst I have particularly described my invention with respect to a preferred embodiment including minor variations thereof, it will be apparent that many other alternatives will be possible and even desirable according to specific circumstances. Thus it would be possible to reverse the positions of channel 57 and its mating tongue 67. A further alternative would be to employ the spacing between the facing edges of the walls of liners 25 and 35 as a channel, and to conform the edges of panels 41 and 42 thereto. The scope of my invention should not be limited to the precise embodiments shown, but the appended claims.

The embodiments of the invention in which an exclusive property or privilege is claimed are defined as follows:

1. In a combined refrigerating freezing appliance having two compartments with a common vertical partition wall, an improved means of reducing undesired thermal flow between said compartments, said means comprising:

a separate liner for each compartment, each of said liners having a top, bottom, rear, and outer side wall;

said liners being positioned in an encasing shell and spaced therefrom, with foam insulation material in the space between said liners and the shell, adjacent edges of said liners being spaced apart;

a separate partition wall including a pair of opposed, spaced apart sheet members havng spaced apart adjacent edges, with foam insulation material between said sheet members;

complimentary channel and tongue means along the spaced apart adjacent edges of said liner and said partition wall, said complimentary channel and tongue being in the form of a truncated V;

whereby said partition wall maybe slidably positioned to divide said appliance into the two compartments with neither of said partition wall sheet members or portions thereof being common to both compartments.

2. An appliance as defined in claim 1 wherein said truncated V channel is formed by outwardly folding adjacent portions of each said liners.

3. An appliance as defined in claim 2 wherein said truncated V channel is formed in each of the top, bottom and rear walls of said liners.

4. An appliance as defined in claim 3 wherein a resilient sealing strip positioned between said channel and tongue.

5. An appliance as defined in claim 3 wherein a resilient sealing strip is positioned between said channel and tongue.

6. An appliance as defined in claim 2 wherein said partition wall has a thickness greater than the width of said channel and shoulders are formed intermediate the planar portions of said partition wall sheet members, thereby to stiffen said partition wall and to conceal the edges of the various panels.

* * * * *